US005310057A

United States Patent [19]

Caldwell et al.

[11] Patent Number: 5,310,057

[45] Date of Patent: May 10, 1994

[54] FABRIC SOFTENER SHEET DISPENSER

[75] Inventors: Lawrence W. Caldwell, Hanover, Pa.; Kara Sturdy, Reisterstown, Md.

[73] Assignee: Lever Brothers Company, Division of Conopco, Inc., New York, N.Y.

[21] Appl. No.: 805,275

[22] Filed: Dec. 10, 1991

[51] Int. Cl.[5] ..... B65D 85/62

[52] U.S. Cl. ..... 206/494; 221/63; 252/8.6

[58] Field of Search ..... 206/0.5, 494, 812, 205; 252/8.6, 8.7, 8.8, 8.9, 90; 427/242; 221/63

[56] References Cited

U.S. PATENT DOCUMENTS

| | | | |
|---|---|---|---|
| 1,910,409 | 5/1933 | Schwartzberg . | |
| 1,988,582 | 1/1935 | Weiss . | |
| 2,009,464 | 7/1935 | Winter | 206/494 |
| 2,334,536 | 11/1943 | Broeren et al. . | |
| 2,473,492 | 6/1949 | Shina . | |
| 2,529,853 | 11/1950 | Taggart . | |
| 2,651,409 | 9/1953 | Fay . | |
| 2,656,916 | 10/1953 | Henderson . | |
| 2,973,086 | 2/1961 | Thompson . | |
| 3,047,141 | 7/1962 | Burns . | |
| 3,167,238 | 1/1965 | Smith . | |
| 3,207,361 | 9/1965 | Marcalus . | |
| 3,224,632 | 12/1965 | Marcalus . | |
| 3,583,597 | 6/1963 | Buttery et al. . | |
| 3,696,034 | 10/1972 | Hewitt et al. | 252/8.6 |
| 3,737,095 | 6/1973 | Derauf . | |
| 3,819,043 | 6/1974 | Harrison . | |
| 3,895,128 | 7/1975 | Gaiser | 427/242 |
| 3,944,694 | 3/1976 | McQueary | 427/242 |
| 3,982,685 | 9/1976 | Shimada . | |
| 4,044,919 | 8/1977 | Olson . | |
| 4,170,678 | 10/1979 | Urfer et al. | 252/8.6 |
| 4,200,200 | 4/1980 | Hein, III et al. . | |
| 4,201,291 | 5/1980 | Davidson . | |
| 4,221,304 | 9/1980 | Wahl et al. . | |
| 4,405,078 | 9/1983 | Dutcher et al. . | |
| 4,413,769 | 11/1983 | Michetti . | |
| 4,416,369 | 11/1983 | Burns . | |
| 4,417,661 | 11/1983 | Roccaforte . | |
| 4,423,105 | 12/1983 | Dillarstone | 427/242 |
| 4,459,127 | 7/1984 | Kunzel . | |
| 4,502,514 | 3/1985 | Ballard et al. . | |
| 4,512,476 | 4/1985 | Herrington, Jr. | 206/494 |
| 4,513,862 | 4/1985 | Mallow . | |
| 4,648,510 | 3/1987 | Kuenzel . | |
| 4,714,191 | 12/1987 | Richardson . | |
| 4,714,643 | 12/1987 | Kuenzel . | |
| 4,733,774 | 3/1988 | Ping, III et al. | 427/242 |
| 4,735,738 | 4/1988 | Willman | 427/242 |
| 4,745,021 | 5/1988 | Ping, III et al. | 252/90 |
| 4,805,800 | 2/1989 | Nocek et al. . | |
| 4,817,790 | 4/1989 | Porat et al. . | |
| 4,882,917 | 11/1989 | Mizusawa et al. | 252/8.6 |
| 5,054,612 | 10/1991 | Meyer, Jr. . | |
| 5,054,619 | 10/1991 | Muckenfuhs . | |
| 5,085,323 | 2/1992 | Kuchenbecker et al. . | |

FOREIGN PATENT DOCUMENTS

| | | | |
|---|---|---|---|
| 0662873 | 5/1963 | Canada | 206/494 |
| 0020522 | 3/1910 | Denmark | 206/494 |
| 0352534 | 1/1990 | European Pat. Off. | 206/494 |

OTHER PUBLICATIONS

Admission of Applicant regarding dove tail sheets, filed Nov. 5, 1992.

*Primary Examiner*—Jimmy G. Foster

*Attorney, Agent, or Firm*—Gerard J. McGowan, Jr.

[57] ABSTRACT

A carton for housing sheets, particularly dryer sheets. The dryer sheets are preferably stacked in a "C" shape and are removed via an access flap which may include 2 hinges and may be reclosable. The ratio of the length of the horizontal axis of the access flap is preferably of a defined ratio to the width of the sheet.

7 Claims, 9 Drawing Sheets

FIG. 4
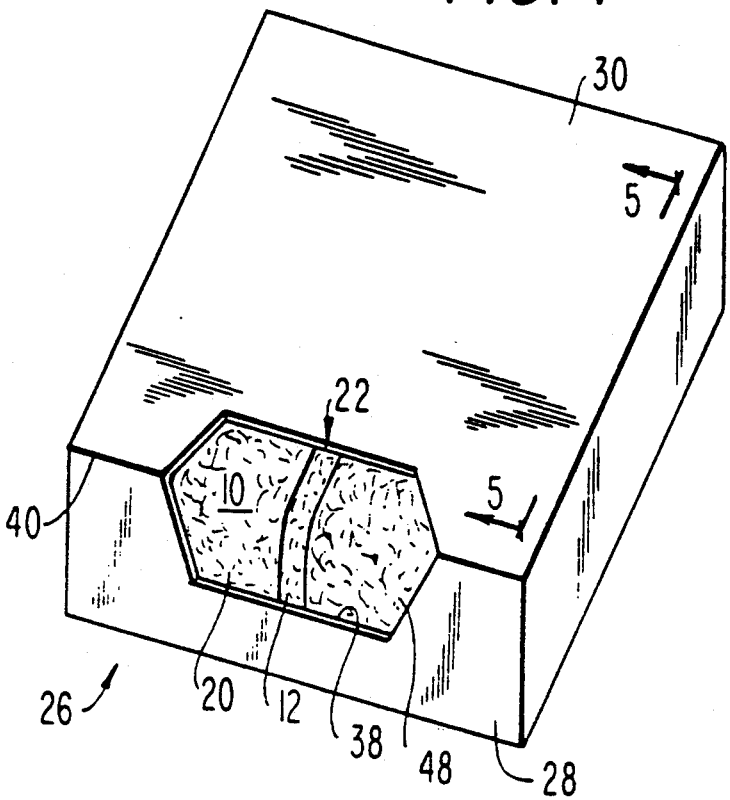
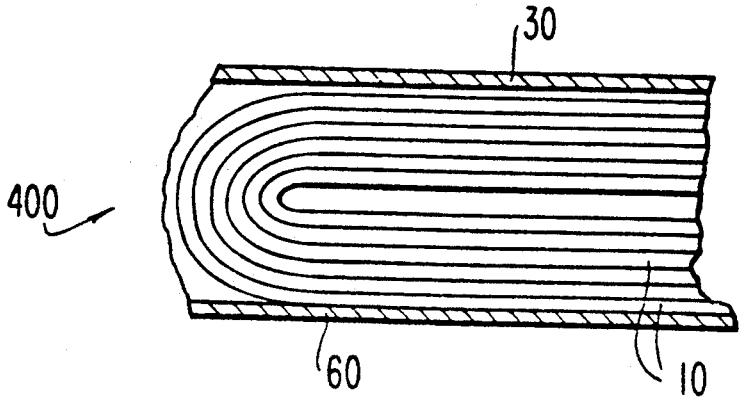
FIG. 5

FABRIC SOFTENER SHEET DISPENSER

BACKGROUND OF THE INVENTION

A convenient method of applying fabric softener to clothes entails the use of sheets impregnated with fabric softening materials. These sheets may be readily placed in the dryer with the clothes. During drying the fabric softening actives and optionally other materials, such as perfumes, are transferred to the clothes.

Fabric softener sheets are typically provided to consumers in the form of a roll. Individual sheets are formed by separating the sheets from the roll at lines of weakness provided at intervals along the roll. Since the sheets need to withstand the temperature conditions of a clothes dryer, they must be comprised of fairly durable plastic. They must also be sufficiently durable to withstand the tumbling action of the dryer without losing their integrity. The sturdy construction of the sheets, while advantageous for keeping the sheets intact during the drying process, has the disadvantage that it is difficult to create a perforation permitting the consumers easily to separate one sheet from another on a roll.

Additional problems associated with the use of dryer sheets include the escape of fragrance from the carton prior to use.

Sheets of various shapes are known for use in household products. Individually folded dove tail sheets are known for products such as dusting cloths.

SUMMARY OF THE INVENTION

The present invention concerns dryer sheets which are individually packaged rather than torn from a roll. Additionally, use of the sheets is facilitated by providing each individual sheet with a dove tail fold which can be readily grasped. In one embodiment, a hexagonal aperture spans portions of both the top and front carton panels. The aperture is wide at the middle and narrows toward the top and bottom so that the sheet can be readily grasped and pulled through the wide middle without inordinate escape of perfume, which is restricted by the narrowness of the opening at the top and bottom.

In accordance with a preferred embodiment wherein the sheets are stacked within the carton in a generally "U" shape folded along their transverse axes, the width of the carton aperture at the bight of the fully loaded stack of sheets is such that the ratio of the width of the carton at that point to the width of the sheet is within the range of about 0.55 to about 0.76, preferably about 0.6 to about 0.66.

In another preferred embodiment, the aperture in the carton through which access to product is provided to the consumer is reclosable by means of a double jointed flap. The double jointing of the flap eases reclosure of the carton as well as opening of the flap.

For a more complete understanding of the above and other features and advantages of the invention, reference should be made to the following detailed description of preferred embodiments and to the accompanying drawings.

BRIEF DESCRIPTION OF THE DRAWINGS

FIG. 4 is a perspective view of the combined carton and sheets of the invention.

FIG. 5 is a cross-section along the lines 5—5 of FIG. 4.

DETAILED DESCRIPTION OF THE INVENTION

The sheets 10 are fabricated from a durable, woven or non-woven material which will normally be a fibrous polymeric material such as polyester or rayon. The material must have a melting point such that it will not melt at temperatures prevalent in clothes dryers. Typically, the melting point of the sheet will be above about 220° C. The sheet is impregnated with materials known in the art suitable for transfer to the clothes during drying to provide a softening effect. Materials suitable for use in fabric softening sheets are described in Rudy et al. U.S. Pat. Nos. 4,421,792; 4,327,133; 4,238,531; 4,012,326 and 3,972,131, the disclosures of which are incorporated herein by reference, among others.

Figure 1:
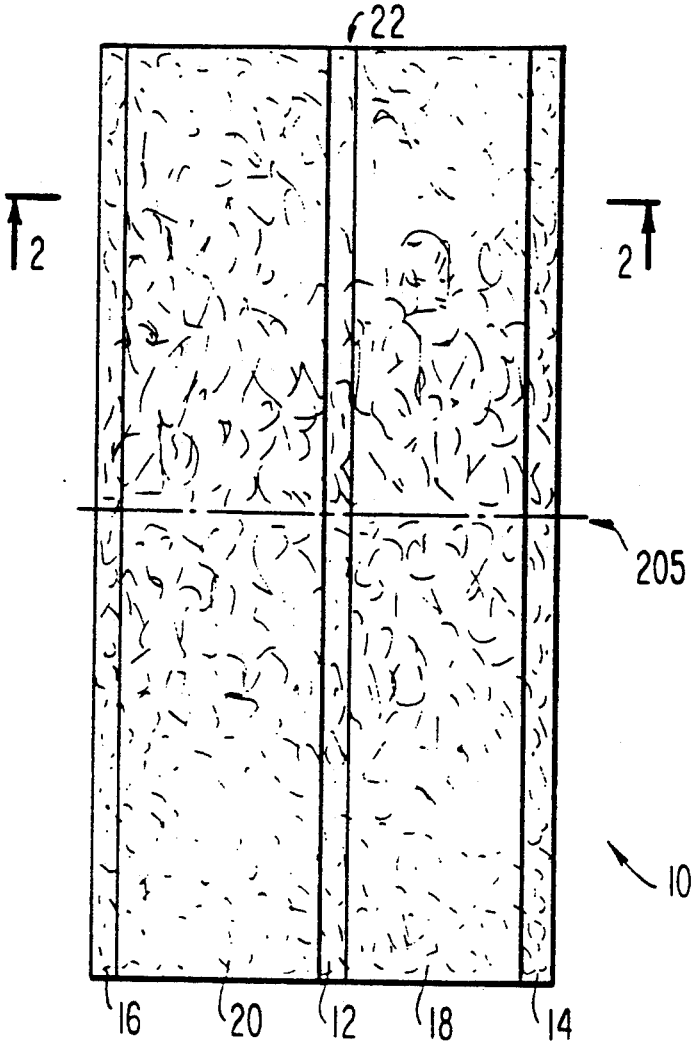
FIG. 1 is a top plan view of a dryer sheet of the invention.
Figure 2:
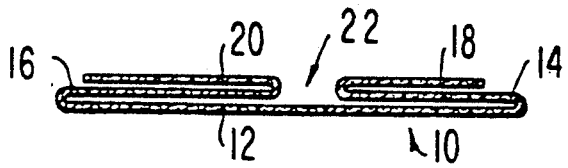
FIG. 2 is a cross-section along the lines 2—2 of FIG. 1.

The sheet is provided with a dove tail fold, as can best be seen in FIGS. 1 and 2. The essence of the dove tail fold is that the sheet includes a flat bottom layer, intermediate layers formed by medial folds on each of the sides of the flat bottom layer and at least one and preferably two top layers folded laterally away from the center of the sheet. Ideally, an appreciable space or gap is left between the medial edges of the top layer.

The dove tail folds of the sheet 10 can be seen particularly in FIG. 2 wherein the flat bottom layer is denoted by reference number 12 and is folded medially to form two intermediate layers 14 and 16 which in turn are folded laterally to form two top layers 18 and 20. An appreciable gap 22 is left between the medial edges of the folds which form the top layers 18 and 20.

The folds are effected using equipment such as an SRI machine available from Accratec of Neenah, Wis.

Figure 3:
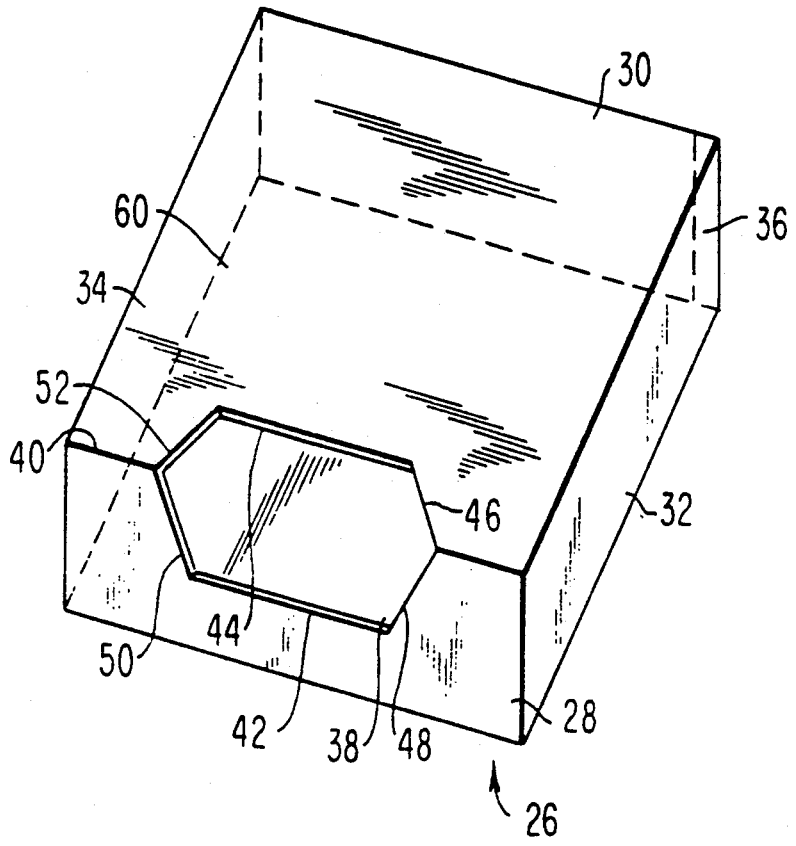
FIG. 3 is a perspective view of an erected carton according to the invention.

As seen particularly in FIG. 3, carton 26 includes front panel 28, rear panel 30, first side panel 32, second side panel 34 and gluing flap 36. Aperture 38 is hexagonal and straddles scoreline 40 which separates top panel 30 from front panel 28. Aperture 38 extends through portions both of front panel 28 and top panel 30.

In order to conserve perfume, the carton 26 may be provided to the consumer with perforations defining the aperture so that the consumer can remove those portions of top and front panels 30 and 28 defined by the perforations to open the carton and form the aperture. This will conserve perfume and minimize its release into the air surrounding the carton while the carton is stored prior to use.

Cut lines 42 and 44, which extend parallel to scoreline 40, are appreciably smaller than the horizontal axis of the aperture (along scoreline 40). This provides the aperture with a wide opening in the middle yet with a restricted area at the top and bottom, which better contains the perfumes.

In FIG. 4, the carton 26 is shown having sheets 10 inserted therein. The sheets are inserted so that the gap 22 is centrally located within aperture 38. The sheets are folded along their transverse axes 205 roughly halfway between the top and the bottom of the sheet (see FIGS. 1 and 5). Preferably, the sheets are not interleaved but lie adjacent to each other without any interlocking of the folded layers between adjacent sheets. Likewise, the sheets are preferably not disposed within the folds of any adjacent sheets. The absence of interleaving results in less loss of perfume and exposure of the sheets to the air since interleaving would result in partial removal of the subsequent sheet after removal of the previous one. No insert is required within the carton to support the stack. As illustrated in FIG. 5, the U-shape of the stack is formed from a single fold in each of the sheets. The stack preferably folds only in the "U"-shape; the arms of the U do not themselves fold again along a transverse axis of the sheets. The sheets do not require any starting stripes to remove the first or subsequent sheets from the carton. The first sheet is identical to subsequent sheets.

When the consumer wishes to use one of the sheets, he/she simply grasps the sheet through the aperture 38 at one of the folds which forms the upper and intermediate sheets. Grasping of the sheet is facilitated by the presence of gap 22. The long axis of the aperture along scoreline 40 facilitates removal of the sheet whereas the minimized vertical dimension of the aperture from top to bottom as reflected in the decreased length of cuts 42 and 44 relative to the longitudinal axis through the scoreline and the angle of the cuts serve to minimize the escape of perfume through the aperture. The "C" fold of the sheets also facilitates removal.

A preferred carton is illustrated in FIGS. 6–9. Carton 126 comprises front panel 128, outer major side flap 132, inner major side flap 133, second outer major side flap 134, second inner major side flap 135, rear panel 130 and bottom panel 160. Perforated lines 111 define a product access flap 115 which is permanently joined to the top panel 130 by scoreline 117. As can be seen particularly in FIG. 6, access flap 115 comprises portions both of front panel 128 and top panel 130, including a portion of scoreline 140 which separates the top from the front panels.

In accordance with one aspect of the invention, the access flap is specially designed so that when the dryer sheets are fully loaded within the box in the "U" orientation wherein the bight or inflection point 400 faces the access opening, the ratio of the access opening to the width of the dryer sheets is within a defined range. In particular, it is preferred that the ratio is within the range of about 0.56 to about 0.76, especially about 0.55 to about 0.70, and most preferably about 0.60 to about 0.66. Design of the carton in accordance with the above ratios is believed to facilitate removal of the sheets by the consumer.

The ratio of the area of the plane of the folded sheet to the area of the access opening is preferably within the range of 1:2.5 to 1:50.

Advantageously, access flap 115 includes 2 hinges. Both scorelines 117 and 140 of the access flap serves as hinges. The advantage of the second hinge will be apparent from the description below.

Figure 7:
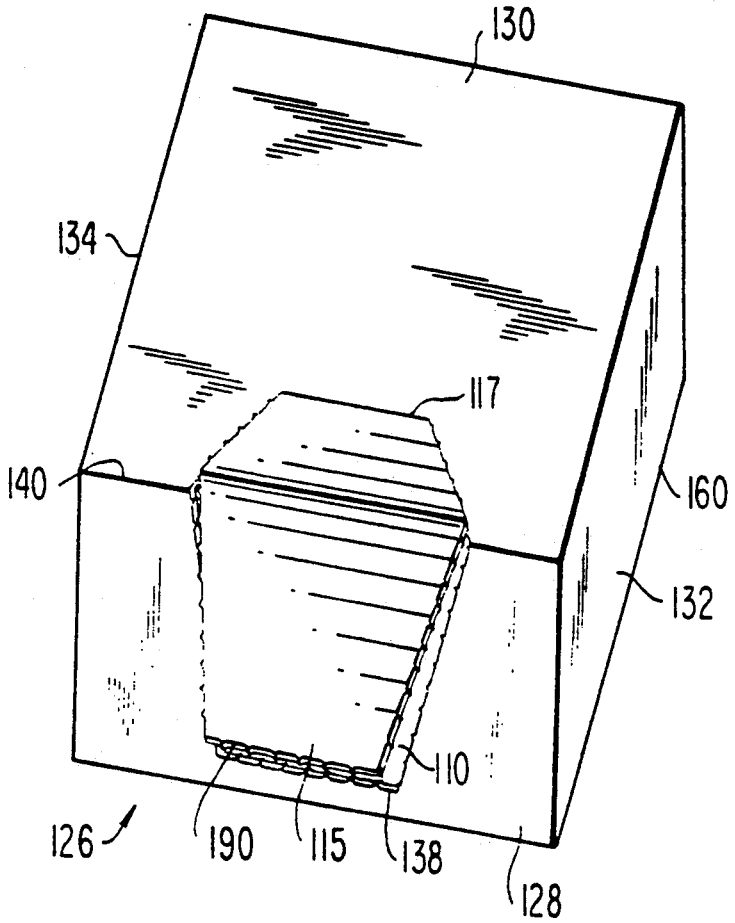
FIG. 7 is a perspective view of the carton of FIG. 6 having the access flap partially open.

When it is desired to use one of the fabric softener sheets, the consumer will push against the bottom of access flap 115. Perforations 111 will permit severance of the connections between the access flap and the front panel 128 and top panel 130 except for scoreline 117 wherein the access panel will remain attached to the top panel. Once the perforations have been severed, the flap will remain opened as seen in FIG. 7. Behind flap 115, dryer sheet 110 can be seen.

Figure 8:
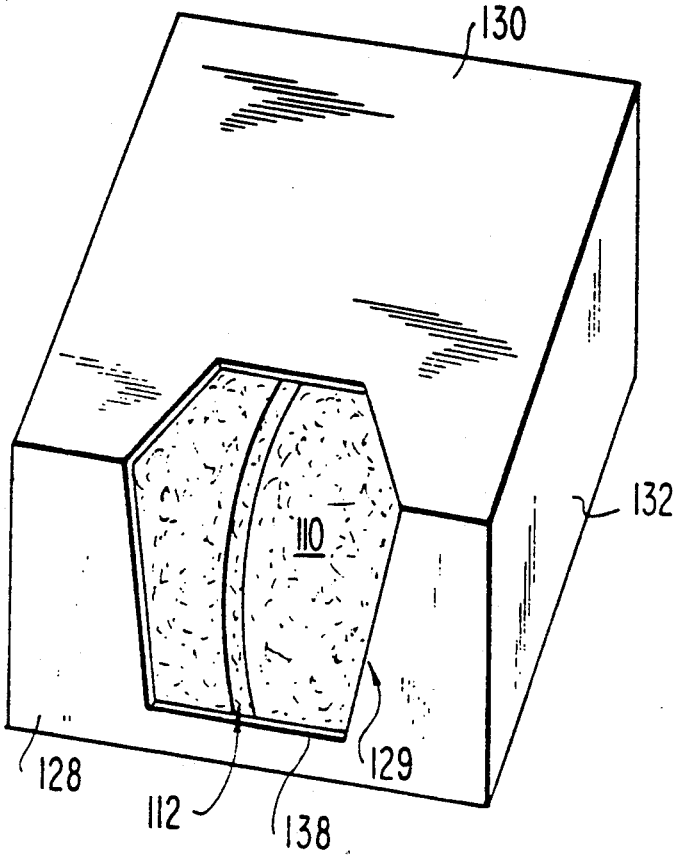
FIG. 8 is a perspective view of the carton of FIG. 6 having the access flap completely removed for purposes of illustration.

Severance of the perforations 111 creates a product access opening 138 best seen in FIG. 8. When the consumer desires to remove a sheet, he/she will hold back the access flap 115 against the top 130 of the carton and grasp the fabric softening sheet at gap 112 as described hereinbefore with respect to the earlier embodiment. The width of the access opening at 129, which constitutes the bight of the full stack of dryer sheets is within the ratio defined above to facilitate removal of the sheets.

For a 20 sheet carton, the height of the carton would typically be $1\frac{1}{4}$ inches, the length $4\frac{5}{8}$ inches and the width of $4\frac{1}{2}$ inches. For a 20 sheet carton, the height could be expected to be within the range of from 1 to $1\frac{1}{2}$ inches. For a 40 sheet carton, the height would typically be $2\frac{1}{4}$ inches, and the length and width the same as for the 20 sheet carton. The height could vary from 2 to $2\frac{1}{2}$ inches. For the 60 sheet carton, the height could be 3 inches, ranging from $2\frac{2}{3}$ inches to $3\frac{1}{4}$ inches. The length and width would be as for the other cartons.

Figure 9:
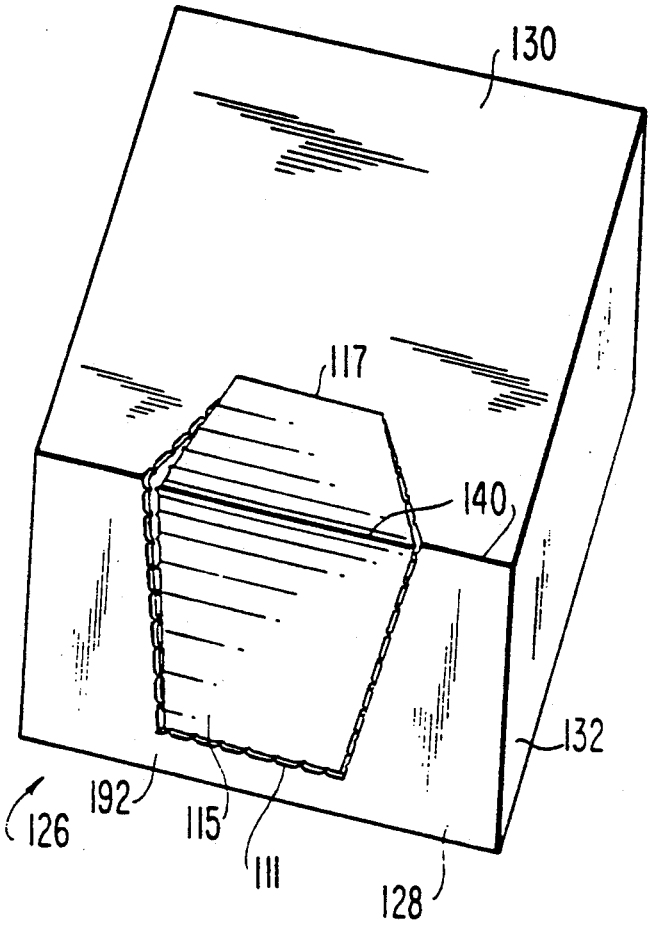
FIG. 9 is perspective view of the carton of FIG. 6 which is reclosed in accordance with the present invention.

When the consumer has removed the dryer sheet from the carton, the carton may be reclosed by grasping access flap 115 and pushing it downwardly inside aperture 138 as shown in FIG. 9. The presence of the two hinges permits the access flap readily to stay within the access aperture when so positioned. The bottom edge 190 of access flap 115 stays behind the lower aspects 192 of front panel 128 thereby keeping the carton closed when not in use. Scoreline 117 also functions as a hinge by permitting the access flap to pivot and thereby open and close. Scoreline 117 also permits the access flap to become disposed slightly rearwardly within the carton upon reclosure so that access flap 115 is positioned securely behind lower aspect 192 of front panel 128. Scoreline 140 serves as a second hinge to permit the access panel portion therebelow to pivot and rest comfortably and securely behind lower aspect 192 of the front panel 128.

The use of a reclosable flap helps minimize unwanted escape of perfume into the air when the sheets are not being used and helps protect the sheet from moisture and other elements in the air.

Figure 10:
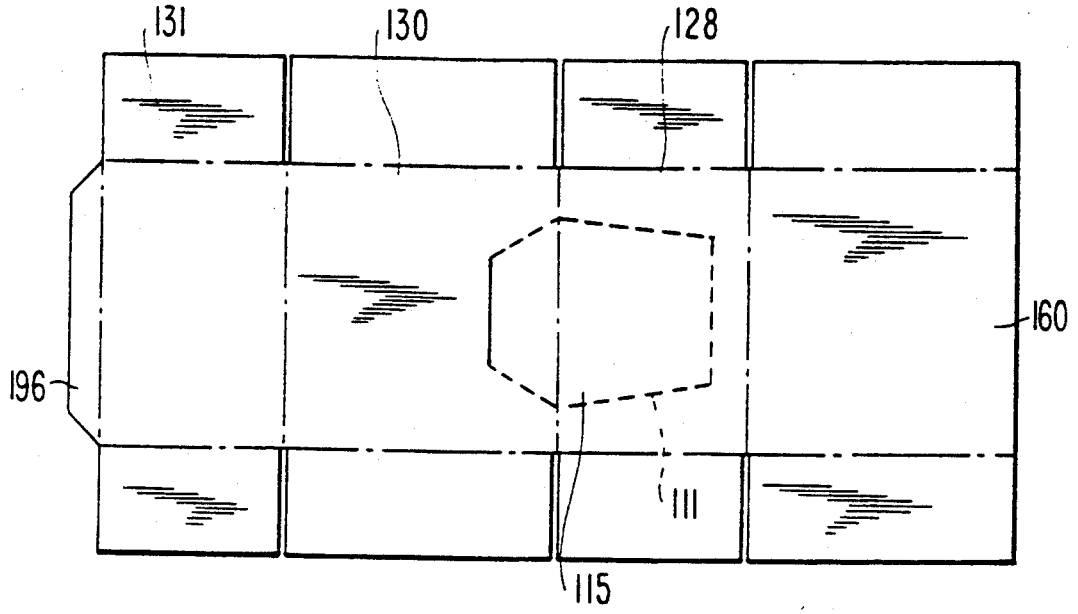
FIG. 10 is a plan view of the carton blank from which the carton of FIG. 6 can be prepared.

The carton blank used to form carton 126 is seen in FIG. 10. The blank comprises a bottom panel 160, a front panel 128, top panel 130 and rear panel 131. Perforated lines 111 define the access panel 115. Glue flap 196 is appended to rear flap 131 for gluing rear flap 131 to bottom flap 160.

A stack of sheets is loaded into carton 126 in the same manner as shown in FIG. 5 with respect to carton 26.

Figure 6:
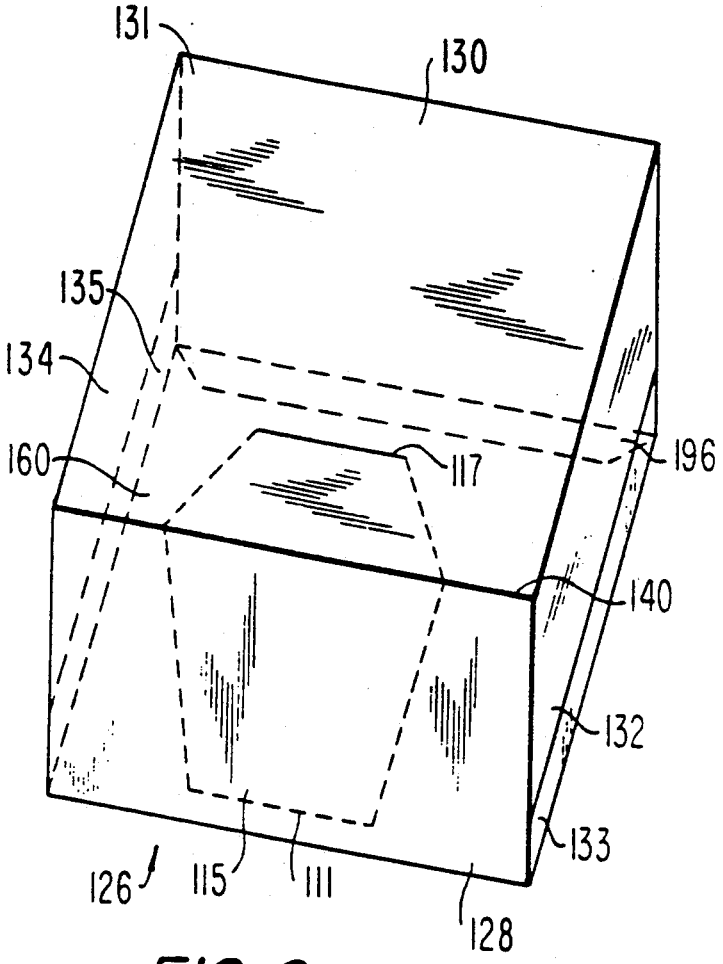
FIG. 6 is a perspective view of an alternate carton of the invention.
Figure 11:
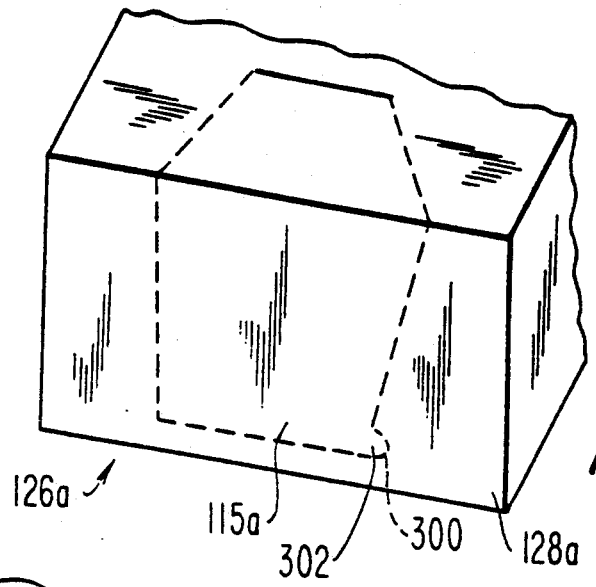
FIG. 11 is a partial perspective view of the carton of FIG. 6 having an access opening according to an alternate embodiment.
Figure 12:
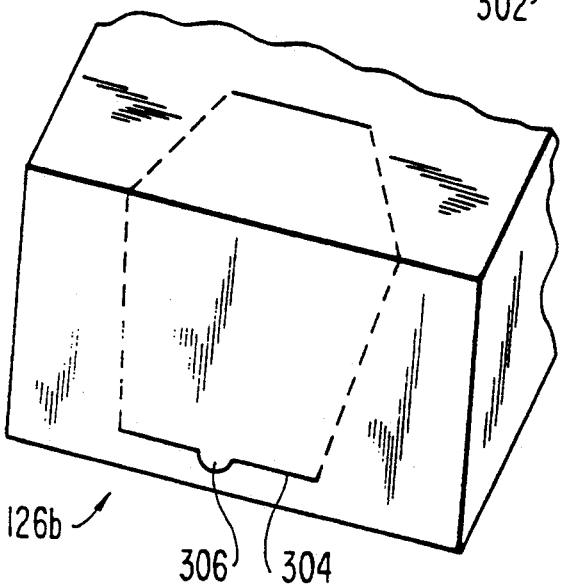
FIG. 12 is a partial perspective view of the carton of FIG. 6 having an access opening according to a further alternate embodiment.
Figure 13:
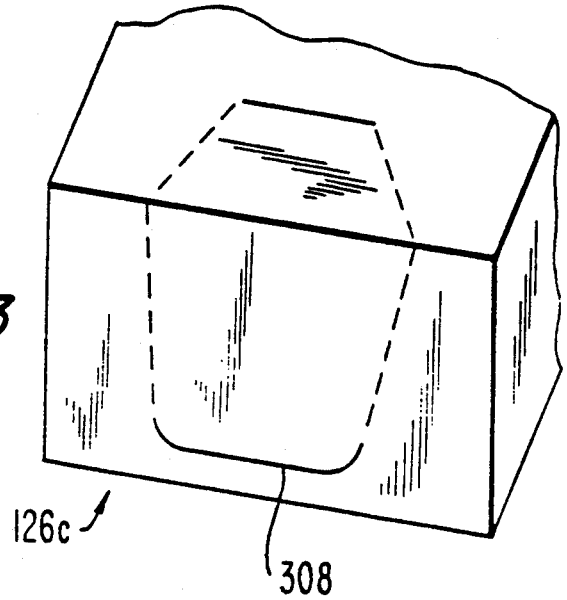
FIG. 13 is a partial perspective view of the carton of FIG. 6 having an access opening according to another alternate embodiment.

FIGS. 11–13 show alternate embodiments of the access opening shown in FIG. 6. Cartons 126*a*, 126*b* and 126*c* are the same as carton 126, except as noted below. In FIG. 11, product access flap 115*a* includes in its lower right hand corner a rounded cut 300 facilitates opening of the access flap by defining a tab 302.

In carton 126*b* of FIG. 12, the bottom periphery 304 is cut to include a rounded tab 306. In carton 126*c* of FIG. 13, the rounded bottom 308 eases opening of the carton.

What is claimed is:

1. A carton containing therein a stack of individual, separate fabric softener sheets which are not interleaved, said stack overall forming a generally U-shape having a bight, said carton including a top panel and a front panel, said front and top panels including lines of weakness defining a reclosable access flap, one of said front or top panels including a first scoreline defining a hinge by which said access flap is permanently attached to said top or front panel, a panel-separating scoreline separating said front and top panels, at least a portion of said panel separating scoreline traversing said access flap whereby said portion of the panel-separating scoreline traversing said access flap is positioned to act as a second hinge for opening and reclosure of said access flap, said bight facing the access aperture, said carton not containing an insert supporting the stack of individual sheets.

2. The carton according to claim 1 wherein the ratio of the width of the access aperture at the bight of the stack to the width of the sheets is between about 0.55 to about 0.75.

3. The carton according to claim 1 wherein the ratio is from about 0.6 to about 0.7.

4. The carton according to claim 1 wherein said sheets are dryer softener sheets.

5. The carton according to claim 1 wherein the individual sheets are folded along their transverse axes, approximately halfway between a top and a bottom of said sheet to form the arms of the U, the arms of said U not themselves folding again along a transverse axis of the sheets.

6. The carton according to claim 1 wherein the individual sheets are folded along their transverse axes, approximately halfway between a top and a bottom of said sheet.

7. The carton according to claim 1 wherein the U shape of the stack is formed from a single fold in each of the sheets.

* * * * *